US005915869A

United States Patent [19]

Agosto et al.

[11] Patent Number: 5,915,869

[45] Date of Patent: Jun. 29, 1999

[54] ERGONOMIC CLEANING APPARATUS WITH MULTIPLE SCRUBBING SURFACES

[75] Inventors: Melina A. Agosto, White River Jct., Vt.; Teodoro Arvizo, III, Stillwater, Okla.; Sean Bradshaw, Hillside, N.J.; Scott K. Hiroshige, Mililani, Hi.; Nicole Thomas, Bx, N.Y.; Eric Wade, Tulsa, Okla.

[73] Assignee: Academy of Applied Science, Concord, N.H.

[21] Appl. No.: 09/014,800

[22] Filed: Jan. 28, 1998

[51] Int. Cl.[6] ..... B43M 11/06; A47L 13/10

[52] U.S. Cl. ..... 401/201; 15/104.93; 15/209.1; 15/229.11; 15/244.4; 15/118; 401/183; 401/207

[58] Field of Search ..... 15/245.1, 118, 15/104.93, 104.94, 208, 209.1, 210.1, 229.11, 244.4; 401/201, 9, 183, 207

[56] References Cited

U.S. PATENT DOCUMENTS

| | | | |
|---|---|---|---|
| 1,388,282 | 8/1921 | Meredith | 15/245 |
| 1,935,485 | 11/1933 | Reynolds . | |
| 3,347,363 | 10/1967 | Dykes . | |
| 3,648,319 | 3/1972 | Mitchell | 15/118 |

FOREIGN PATENT DOCUMENTS

| | | | |
|---|---|---|---|
| 0296670 | 7/1914 | Germany | 15/210.1 |

*Primary Examiner*—Randall E. Chin
*Attorney, Agent, or Firm*—Rines and Rines

[57] ABSTRACT

A substantially tetrahedral squeezable resilient core cleaning utensil provided on its various faces with permanent or removable scrubbing surfaces, including porous surfaces containing detergent and the like.

7 Claims, 3 Drawing Sheets

ERGONOMIC CLEANING APPARATUS WITH MULTIPLE SCRUBBING SURFACES

TECHNICAL FIELD

This invention relates to cleaning utensils used for manually cleaning surfaces such as pots, pans, cupboards, and other objects and surfaces.

BACKGROUND

Sponges and abrasive surfaces such as absorbent foams, brushes, sponges of various sizes and shapes, scouring pads, cooper wool, steel wool, and washcloths have been used for many years as cleaning utensils. One common problem with such cleaning devices is that most are designed safely and effectively to clean only specific type surfaces. For example, steel wool can be used to clean pots and pans, but not more delicate surfaces such as china plates. This is a problem as one must switch between scrubbing surfaces while cleaning items or surfaces which vary in their ability to resist damage from scrubbing. It also leads to a proliferation of cleaning devices.

Many of these cleaning implements offer one or two types of scrubbing surfaces suitable only for scrubbing selective items. Devices such as "O-Cello-O" Sponges, "Scotch Brite" scouring pads, and the scrubbers described in U.S. Pat. Nos. D273,336, 2,255,497, 2,778,044, 2,941,225, 4,159,883, 4,856,134, 4,970,750, and 5,408,718, as examples, are restricted use on a limited number of kinds of surfaces. Other scrubbers, such as those described in U.S. Pat. Nos. 3,581,447, 362,896, 4,159,883, lack the flexibility of scrubber removability and they also lack an ergonomic gripping shape.

The inventions described in U.S. Pat. Nos. 3,581,447, 3,629,896, 415,883, 4,199,835, 4,510,641, 4,665,580, 4,856,134, 4,949,417, 4,974,763, 5,140,785, 5,187,830, 5,331,705, 5,408,717, 5,548,862, and 5,569,521, as further examples of multi-faced cleaning utensils which offer more than one or two scrubbing surfaces, do not provide a comfortable grip, nor do they allow the user to forcibly control pressure at selective regions. They also make no provision for cleaning in cramped spaces. The above mentioned patents also do not have an integrated framework or skeleton which helps to maintain the structural integrity and size of the device and its corners when cleaning in such spaces or when cleaning a surface which requires a large amount of pressure.

Cleaning devices such as those described in U.S. Pat. Nos. D273,336, 2,941,225, 2,778,044, 419,935, 4,856,134, and 5,140,785, furthermore, while containing inner cavities or passageways for detergent or other cleansing agents, do not have an ergonomic design of gripping shape.

In accordance with the present invention, a more universal multiple scrubbing surface cleaning utensil is provided that, while having many of the desirable features of various versions of the different prior art devices above-referenced, provides a novel synergy of shape and scrubbers, that obviates the several limitations and disadvantages above-described.

OBJECT OF THE INVENTION

An object of the invention, accordingly, is to provide a new and more universal, improved cleaning utensil, which can function, in effect, as several cleaning utensils for a variety of different type surfaces and applications.

A further object of the invention is to provide a shape which makes gripping the cleaning utensil easier and makes the cleaning in corners and hard-to-reach areas more effective.

Another object of the invention is to provide a cleaning utensil that allows quick and easy selection of appropriate types of cleaning media, all in one cleaning utensil.

A further object of the invention is to provide such a novel cleaning utensil, which either passively or actively dispenses detergent.

Other and further objects will be hereinafter explained and delineated in the appended claims.

SUMMARY

In summary, the present invention provides a cleaning utensil, which is of such shape and construction as to provide many different scrubbing surfaces all-in-one. A squeezable water absorbent cleaning utensil having a core of the shape of substantially a tetrahedron or pyramid, wherein each face of the core is fitted with one or more scrubbing surfaces. In its preferred embodiment, the invention consists of a tetrahedral shaped core made of sponge or other water-absorbent cleaning material. Multiple, replaceable scrubbing surfaces are attached to the various faces of the core. The scrubbing surfaces may consist of different types of scouring pads, terry cloth, copper wool, steel wool, and different types of sponge materials.

The present invention, moreover, makes swapping between different scrubbing surfaces fast and easy, as they all can exist on one cleaning utensil. This allows users of the invention to choose the best scrubbing surface for use with the particular surface to be cleaned. Cleaning is also facilitated by detergent, which can be stored in cavities within the core, or in the attachments themselves.

The particular shape of the core makes gripping the device ergonomically easier and also facilitates cleaning in cramped areas such as corners, reachable by the points of the tetrahedral shaped core.

Preferred and best mode designs and details are later explained.

BRIEF DESCRIPTIONS OF THE DRAWINGS

DESCRIPTION

The invention consists of a substantially tetrahedral shaped preferably resiliently squeezable core composed of sponge or other water-absorbent material. The shape of the core 1 is designed such that gripping the utensil is comfortable and ergonomically enables the application of pressure on the various scrubbing surfaces being used, as desired. Cleaning in cramped spaces such as corners can easily be done with the corners of the core 1. An integrated framework 20 or skeleton can be used to maintain the structural integrity and size of the core 1 and its comers when cleaning in such spaces, or when cleaning a surface which requires a large amount of pressure. Modifications can also be made to the core shape, such as truncation or rounding of the corners into more conical form, or use of different materials at the edges and corners.

A plurality of different scrubbing surfaces 2, 3, 4, 5 may be permanently or removably attached to the various faces of the core 1 or to a recessed area in each face of the core 1. Each core surface, indeed, may be provided with one or more scrubbing surfaces 2, 3, 4, 5 thus attached. These scrubbing surfaces may consist of different types of scouring pads, terry cloth, copper wool, steel wool, and different types of sponge, etc. When cleaning, one can easily switch between the attached scrubbing surfaces 2, 3, 4, 5 as demanded by the cleaning job. There are many methods for attaching the surfaces, such as hot glue for permanency, "Velcro", stitching and others.

Figure 1:
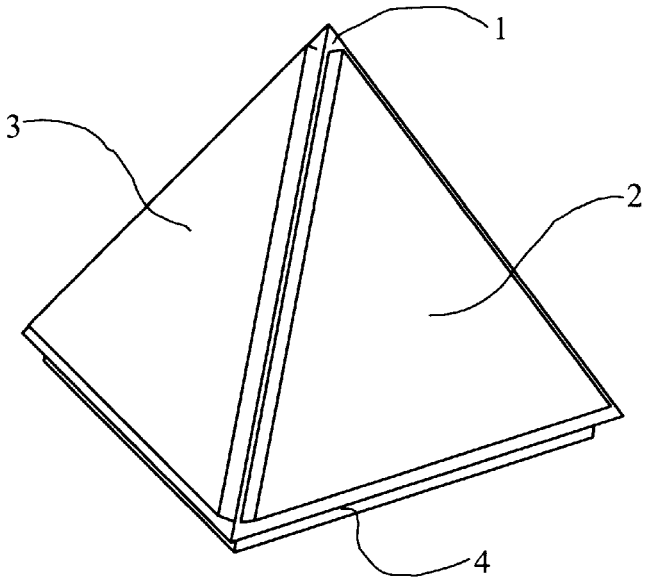
FIG. 1 is a view of the cleaning implement of the invention, showing the preferred tetrahedral core and two attached scrubbing surfaces.
Figure 2:
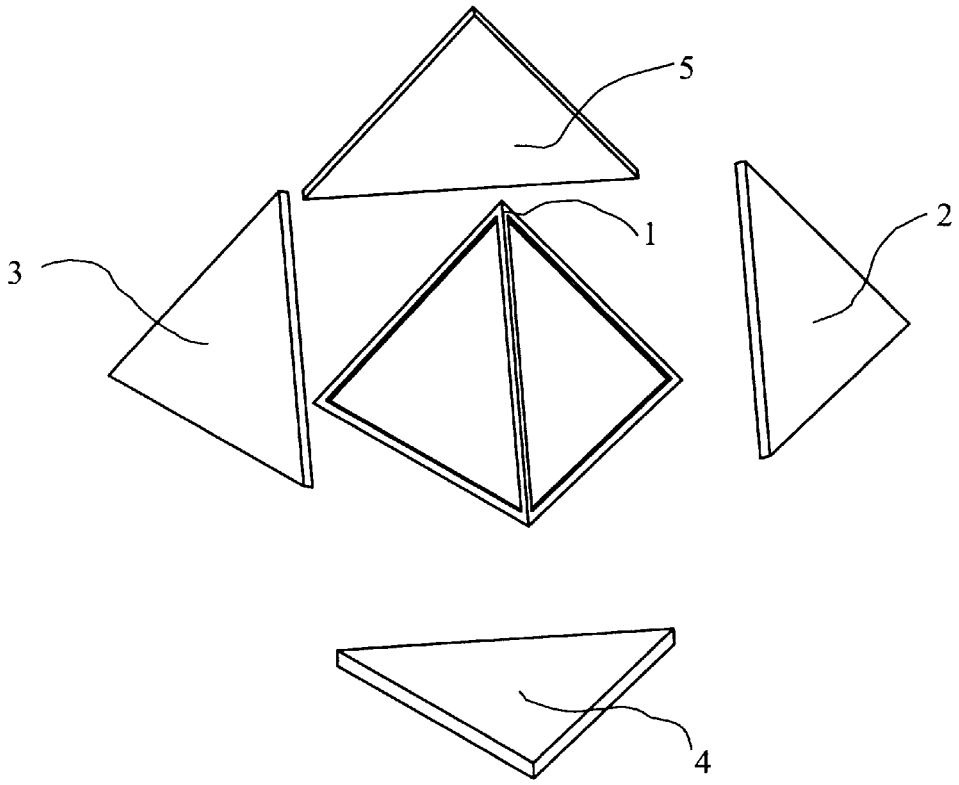
FIG. 2 shows four cleaning surfaces on the respective faces of the core.
Figure 3:
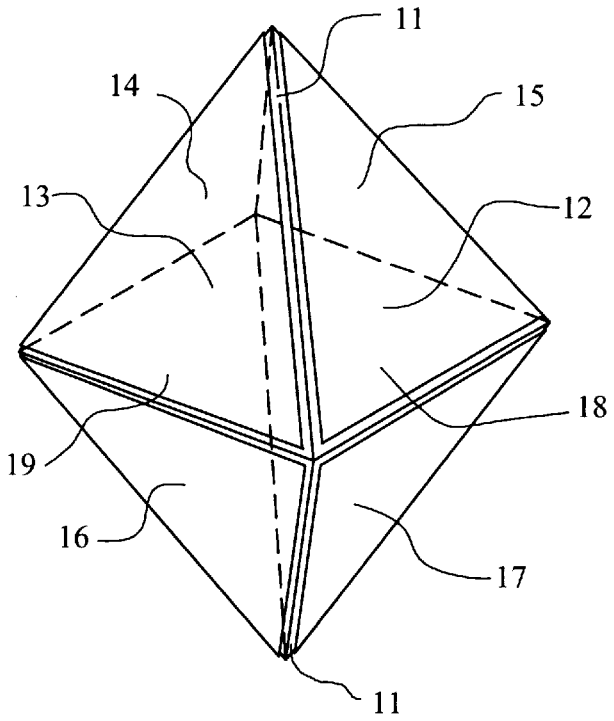
FIG. 3 illustrates one possible variation of the invention in which the core of the cleaning utensil has eight surfaces for attaching scrubbing surfaces.
Figure 4:
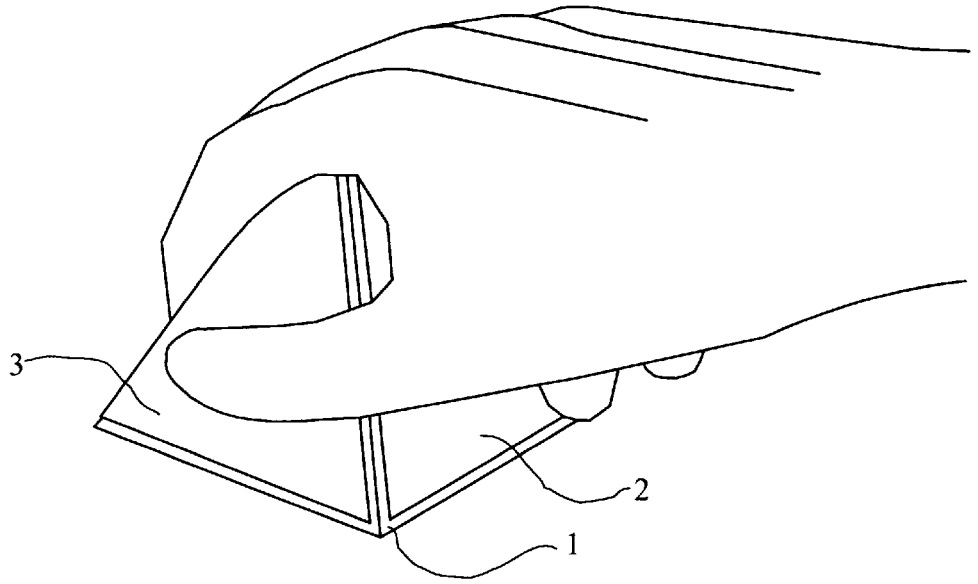
FIG. 4 shows one position in which the implement fits naturally into the palm of the hand.
Figure 5:
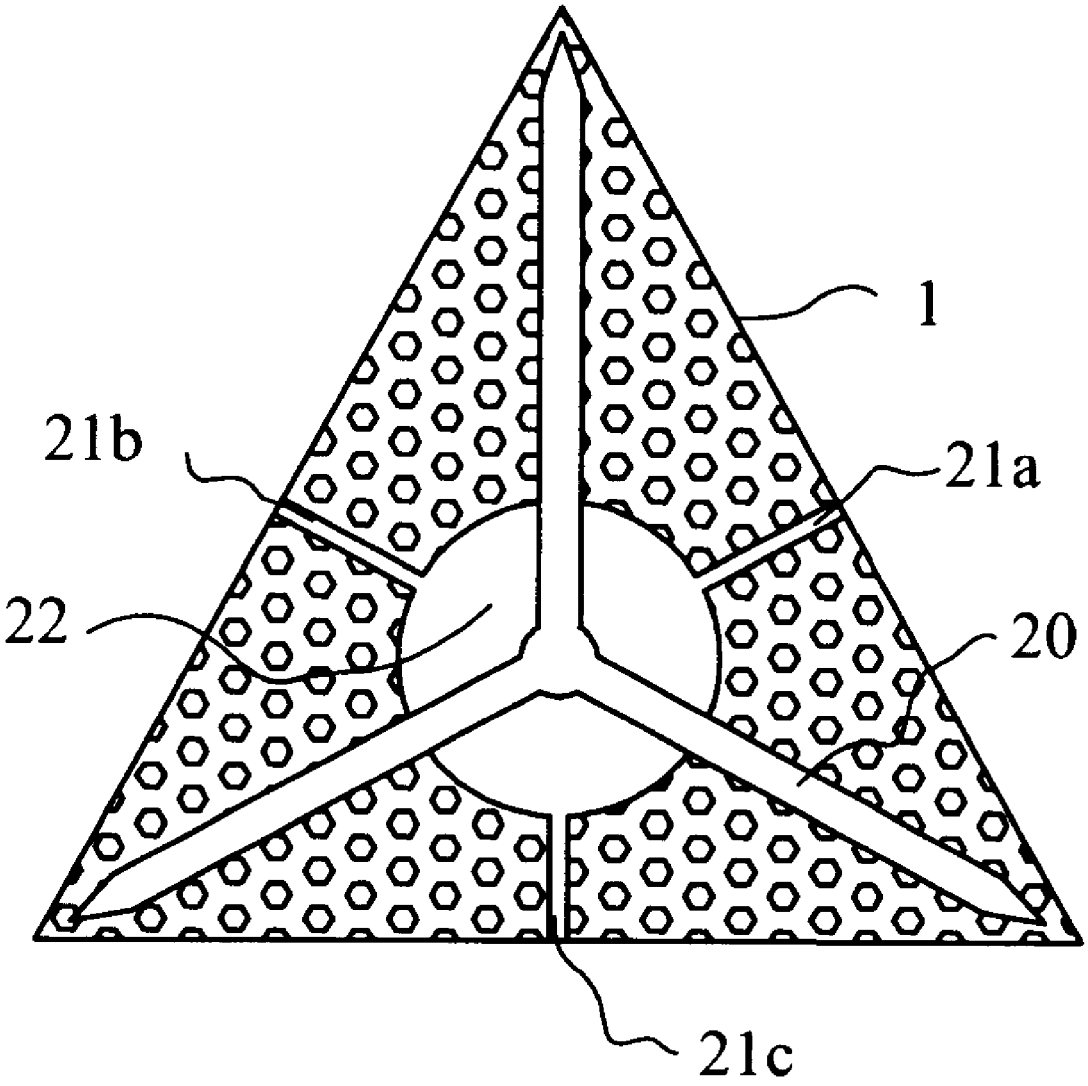
FIG. 5 is a section view of the core, which shows one possible way in which an internal cavity for detergent storage and a framework can be integrated into the core.

In addition, the surfaces 2, 3, 4, 5 may be porous and impregnated or covered with a cleaning agent, or other material which aids in cleaning. Likewise, the core 1 may have internal cavities 22 and passages 21*a*, 21*b*, 21*c*, FIG. 5 which may hold detergent that either seeps through the core 1 material and attachments 2, 3, 4, 5 or is transferred from the holding cavity 22 to the surface being cleaned via a passages 21*a*, 21*b*, 21*c* or holes through the core 1 and attached scrubbing surfaces 1, 2, 3. The same arrangement may also be used in which the detergent is squeezed from the cavity 22 by the user of the device.

The present invention thus provides a cleaning utensil that offers many different scrubbing surfaces. Multiple and replaceable scrubbing surfaces may be attached to the various faces on the core of the cleaning utensil. The scrubbing surfaces may consist of different types of scouring pads, terry cloth, copper wool, steel wool, and different types of sponge.

The invention also thus makes changing between different scrubbing surfaces fast and easy, as they coincide on one cleaning utensil, allowing users to choose the best scrubbing surface for use with the preferred surface to be cleaned. Cleaning may also be facilitated by detergent, which can be stored in cavities or pores within the core, or pores, or in the scrubber attachments themselves.

The novel preferred shape of the core as a tetrahedron makes gripping easier and applying pressure to the device more comfortable. The shape also facilitates cleaning of cramped areas like corners, as these areas can be reached by the points of the tetrahedral shaped core. Other shapes, providing pyramidal or rounded, somewhat more conical shapes may also be used, such herein being intended generically to be embraced by the term "substantially tetrahedral".

Variations, other modifications, and other implementations will occur to those of ordinary skill in the art without departing from the spirit and the scope of the invention claimed. Accordingly, the invention is to be defined not by the preceding illustrative description but instead by the spirit and scope of the following claims.

What is claimed is:

1. A cleaning utensil having a core provided with faces formed in substantially the shape of a tetrahedron, wherein each face of the core is fitted with at least one scrubbing surface and wherein cavities are provided in at least one of the core and the surfaces, filled with detergent to be released by squeezing the utensil.

2. A cleaning utensil as claimed in claim 1 wherein an integrated framework skeleton is provided in the core to aid in maintaining structural integrity.

3. A cleaning utensil as claimed in claim 1 wherein the scrubbing surfaces are removable.

4. A cleaning utensil as claimed in claim 1 wherein the scrubbing surfaces are replaceable.

5. A cleaning utensil as claimed in claim 1 wherein the core is provided with one of truncated and rounded, corners and edges.

6. A cleaning utensil as claimed in claim 1 wherein the core is of water-absorbent sponge material and the scrubbing surfaces are selected from the group consisting of scouring pads, terry cloth, copper wool, steel wool and sponge materials.

7. A cleaning utensil as claimed in claim 6 wherein different of the scrubbing surfaces are form different types of scrubbing material.

* * * * *